US007377841B2

(12) United States Patent
Bartleucci et al.

(10) Patent No.: US 7,377,841 B2
(45) Date of Patent: May 27, 2008

(54) MECHANICAL APPARATUS FOR STUFFING PLUSH TOYS

(76) Inventors: Frank Bartleucci, 168 Wave Rd., Manahawkin, NJ (US) 08050; Pete Pirmann, 18 Douma Dr., Newton, NJ (US) 07860; Todd Gordon, 15 Norman Dr., Shoreham, NY (US) 11786

( * ) Notice: Subject to any disclaimer, the term of this patent is extended or adjusted under 35 U.S.C. 154(b) by 139 days.

(21) Appl. No.: 11/330,946

(22) Filed: Jan. 12, 2006

(65) Prior Publication Data

US 2006/0163291 A1 Jul. 27, 2006

Related U.S. Application Data

(60) Provisional application No. 60/646,479, filed on Jan. 25, 2005.

(51) Int. Cl.
*A22C 11/00* (2006.01)

(52) U.S. Cl. ..... 452/30

(58) Field of Classification Search ..... 452/21, 452/22, 24–26, 30–32, 35, 40–42, 44
See application file for complete search history.

(56) References Cited

U.S. PATENT DOCUMENTS

| | | | | | |
|---|---|---|---|---|---|
| 2,329 | A | * | 11/1841 | Weeks | 125/13.01 |
| 36,232 | A | * | 8/1862 | Perry | 452/41 |
| 95,830 | A | * | 10/1869 | Parker | 452/41 |
| 655,822 | A | * | 8/1900 | Clements | 241/101.5 |
| 1,164,276 | A | * | 12/1915 | Fogarty | 100/150 |
| 1,395,967 | A | * | 11/1921 | Merli et al. | 452/42 |
| 2,377,069 | A | * | 5/1945 | Brubaker | 99/494 |
| 2,572,917 | A | * | 10/1951 | Ell | 452/44 |
| 2004/0219862 | A1 | | 11/2004 | Digby et al. | |

* cited by examiner

*Primary Examiner*—Thomas Price
(74) *Attorney, Agent, or Firm*—Cohen Pontani Lieberman & Pavane LLP

(57) ABSTRACT

A toy stuffing apparatus, including a stuffing drum with a rotating member and a rotating auger below the stuffing drum for transporting the stuffing along the auger shaft and out an exit. Also included is the kit for use in stuffing a stuffed toy.

17 Claims, 4 Drawing Sheets

MECHANICAL APPARATUS FOR STUFFING PLUSH TOYS

RELATED APPLICATIONS

This application claims priority from U.S. Provisional Application No. 60/646,479 which was filed on Jan. 25, 2005.

BACKGROUND OF THE INVENTION

1. Field of the Invention

The present invention is directed to the field of stuffed toys, in particular, an apparatus or kit for stuffing toys.

2. Description of the Related Art

Retail shops at which customers can make customized stuffed toys such as teddy bears are extremely popular. Such toys are also known in the toy trade as "plush". At such retail shops customers choose from a variety of pre-made animal or character "skins", which are the outer fabric casings of the plush toy comprised of fabric panels sewn together into the forms of the animal or character and act as the container, which is inflated into the full shape of the animal or character by being stuffed full of a soft, fluffy stuffing material. In essence, the skin is the plush toy absent the stuffing and decorative detailing. The customer also selects from a variety of facial features to be attached to the skin in the appropriate location after the skin is stuffed and choose from a variety of clothing and other accessories to complete the plush creation.

The focal point of the in-store manufacturing process is the stuffing machine. It is a large piece of heavy equipment that typically measures several feet in length, width, and height, and weighs hundreds of pounds. It is powered by a/c current that runs large motors, blowers and air compressors which, together, generate and direct significant air velocity and pressure needed to force the stuffing from the machine, through an injection tube, and into the skin through a hole in the fabric of the skin. Once filled with stuffing, the skin is removed from the injection rube and the store employee closes the skin fill hole by tying shut laces around the hole, or by some other method of closure, which requires the skill of the store employees.

Due to the size of the machine required for this method of stuffing a plush toy, the machine is also noisy, expensive, and too dangerous to be handled by customers, especially young children. Therefore, the customer merely passively watches, while the employee performs the entire manufacturing process.

Attempts have been made to reduce the size and cost of these stuffing machines to make them more portable and more suitable for the mass market, but the degree to which they can be reduced is restricted by the requirements of the large motors and compressors needed to generate sufficient pressure to fill the skins. Such machines require skill and dexterity not possessed by young children.

Therefore, there remains a need for a toy stuffing apparatus to be reduced to a size, price, or level of skill and safety that would allow them to be used at home by small children as an activity toy, or craft kit.

SUMMARY OF THE INVENTION

One embodiment of the invention includes an apparatus for inserting stuffing into an outer fabric casing, comprising a hollow outer casing, including a stuffing drum with a first end, a second end, and an opening for receiving the stuffing, an auger shaft located below the stuffing drum with the auger shaft including a stuffing exit, and a base located below the auger shaft; at least one rotating member for rotating about a horizontal axis within the stuffing drum, the member being rotated by rotating means connected to the exterior of the first end of the stuffing drum; a rotating auger within the auger shaft, rotating from a first end to a second end positioned near the stuffing exit, and having a diameter smaller than the auger shaft; and a gear system including a rotating member gear located between the rotating member and the rotating means, an auger gear connected to the first end of the auger, and an intermediate gear connecting the member gear and the auger gear, allowing rotation of the rotating means to rotate the auger as well as the member.

Another embodiment of the invention includes a kit for making a stuffed toy at home, comprising an outer fabric casing including closure means; stuffing to fit within the outer fabric casing; an apparatus for inserting the stuffing into the outer fabric casing, including, a hollow outer casing, including, a stuffing drum with a first end, a second end, and an opening, an auger shaft located below the stuffing drum with the auger shaft including a stuffing exit, and a base located below the auger shaft, at least one rotating member for rotating about a horizontal axis within the stuffing drum, the member being rotated by rotating means connected to the exterior of the first end of the stuffing drum, a rotating auger within the auger shaft, rotating from a first end to a second end positioned near the stuffing exit, and having a diameter smaller than the auger shaft, and a gear system including a rotating member gear located between the rotating member and the rotating means, an auger gear connected to the first end of the auger, and an intermediate gear connecting the member gear and the auger gear, allowing rotation of the rotating means to rotate the auger as well as the member; and a stuffing canister, including a hollow transparent cylinder with a top and bottom end for inserting the stuffing into, a piston platform with a diameter slightly less than the cylinder, a plunger rod with a length greater than the length of the cylinder extending from the piston platform up through the top end of the cylinder, and connection means at the bottom of the cylinder to mate with the opening in the stuffing drum.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
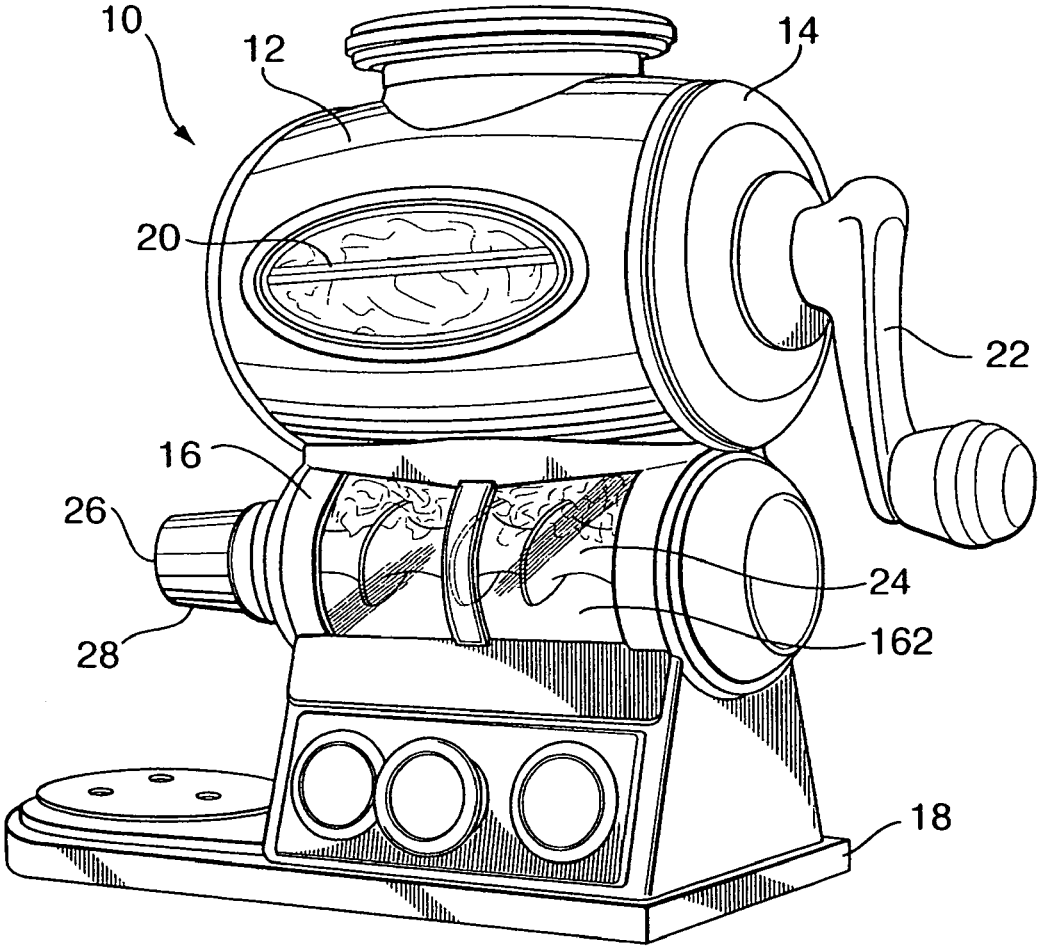
FIG. 1 is a perspective view of the toy stuffing apparatus.
Figure 2:
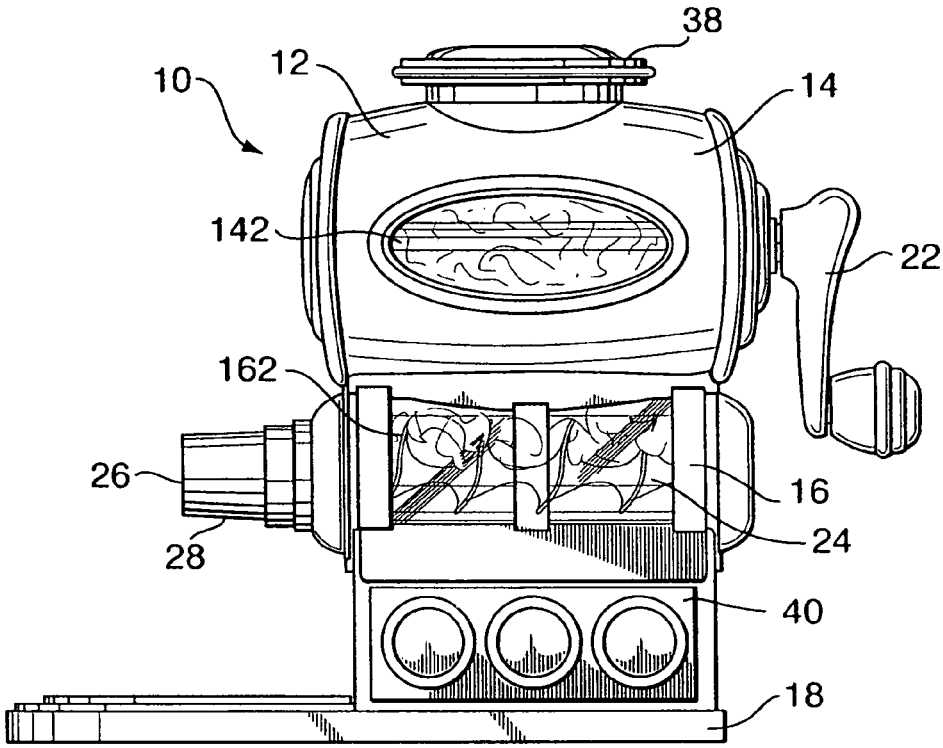
FIG. 2 is a side view of the toy stuffing apparatus from FIG. 1.
Figure 3:
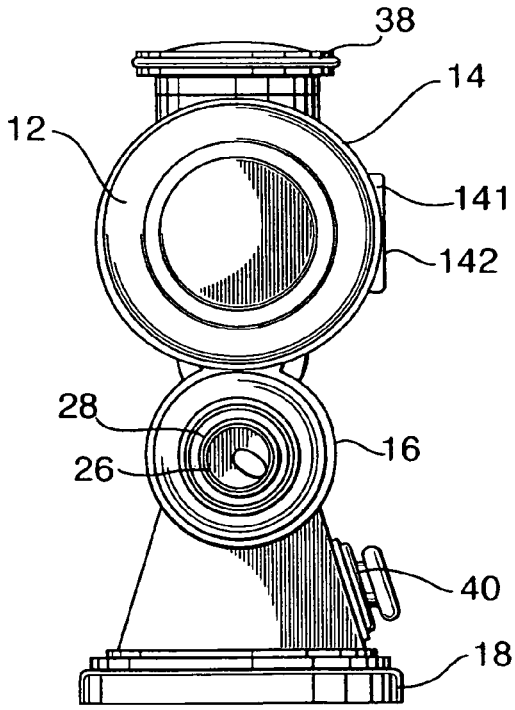
FIG. 3 is an end view of the toy stuffing apparatus from FIG. 1.

FIGS. 1 through 4 show the toy stuffing apparatus 10, including a hollow outer casing 12, which further includes a stuffing drum 14, an auger housing 16, and a base 18.

Figure 4:
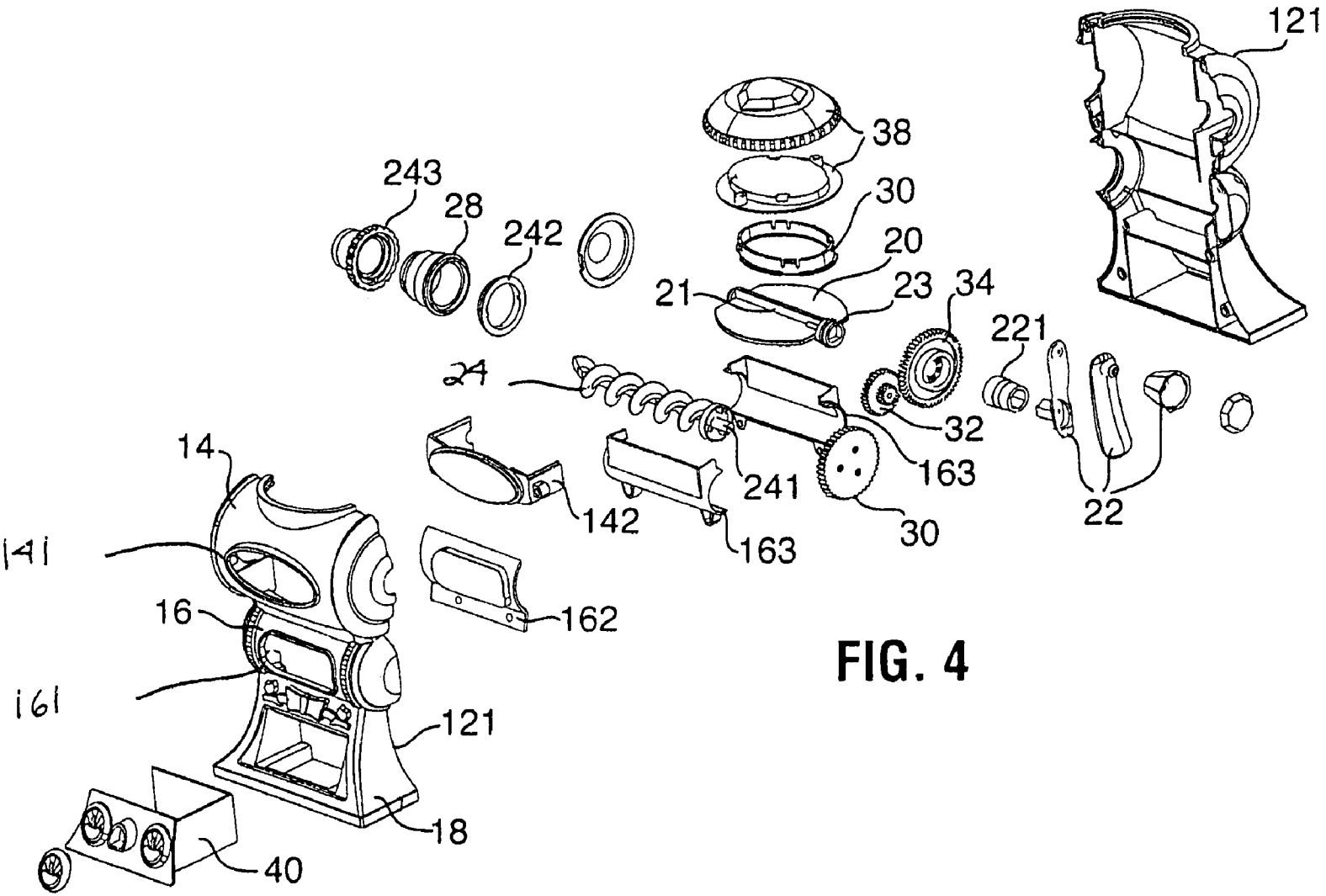
FIG. 4 is an exploded view of the toy stuffing apparatus from FIG. 1.

As can be seen in FIG. 4, within the stuffing drum 14 is a rotating plate 20, which in this main embodiment is shown as a flat disk. This rotating plate 20 rotates around a horizontal axis within the stuffing drum 14, and therefore has a diameter slightly less than the interior of the stuffing drum 14. Rotating plate 20 has a central axle 21 terminating in short pegs 23 that extend through openings in the ends of the stuffing drum 14, where it is attached to rotating means, which can be seen in FIGS. 1 through 4, to be a handle 22 which can be manually rotated.

Referring now specifically to the exploded view of FIG. 4, the mode of construction of a preferred embodiment of the present invention is illustrated. The outer casing of the apparatus is composed of two half shells 121 each of which is formed to defined one half of the drum 14, auger housing 16 and base 18. It will be observed that openings 141, 161 for transparent windows 142, 162 are formed in the drum 14 and auger housing 16 portions of one half shell 121. These windows 142, 162, as illustrated, are held onto the shell by adhesive or suitable fasteners.

Inwardly of the window 162 in the auger housing 16 is located a two-piece auger cylinder 163, in which auger 24 is mounted for rotation. At one end of auger 24 is a short axle 241. The other end is captive in a collar 242 that fits into nozzle 28. Nozzle 28 is held onto the auger housing 16, when the two halves of it are joined, by a threaded retaining ring 243.

As noted, below the stuffing drum 14 is the auger housing 16, which houses the corkscrew-like, rotating auger 24. The auger 24 is positioned within the auger housing 16 to move stuffing towards the stuffing exit 26, which in the main embodiment can be also seen to include a nozzle 28. Nozzle 28 may be tapered. The end of the rotating auger 24 that is not adjacent to the exit 26 is connected via axle 241 to the auger gear 30. As can be best seen in FIG. 4, the auger gear 30 connects to the intermediate reduction gear 32, which, in turn is rotated by the rotating plate gear 34. Plate gear 34 is joined to three piece handle 22 by a fitting 221. Therefore, as the handle 22 is turned, the rotating plate 20 rotates, along with the rotating plate gear 34. As the rotating plate gear 34 rotates, it in turn rotates the intermediate reduction gear 32, which rotates the auger gear 30, and the auger 24 along with it. It will be understood, however, that alternate drive arrangements for connecting the rotating means 22 to the auger will be obvious to one skilled in the art.

Therefore, in use, the stuffing (not shown) is placed within the stuffing apparatus 10, through the stuffing opening 36. A screw cap 38, which has an inner and outer piece, is then used to seal the opening 36, and the handle 22 is turned, allowing the stuffing to tumble around within the stuffing drum 14. Since the interior of the hollow outer casing 12 is open, the stuffing will shift downward, from the stuffing drum 14, and into the auger housing. 16. Once in the auger housing 16, the auger 24 will force the stuffing along the auger housing 16, and out the stuffing exit 26, and into whatever fabric casing the user is stuffing at the time.

Some other elements of the main embodiment can be seen in FIGS. 1 through 4. In the base 18, there is a storage compartment 40, in which decorative accessories for the toy may be stored. As well, since this is a toy and children would be using it, visual appeal is offered by way of windows 142, 162, allowing the child to see the stuffing tumbling around within both the stuffing drum 14 and the auger housing 16.

Figure 5:
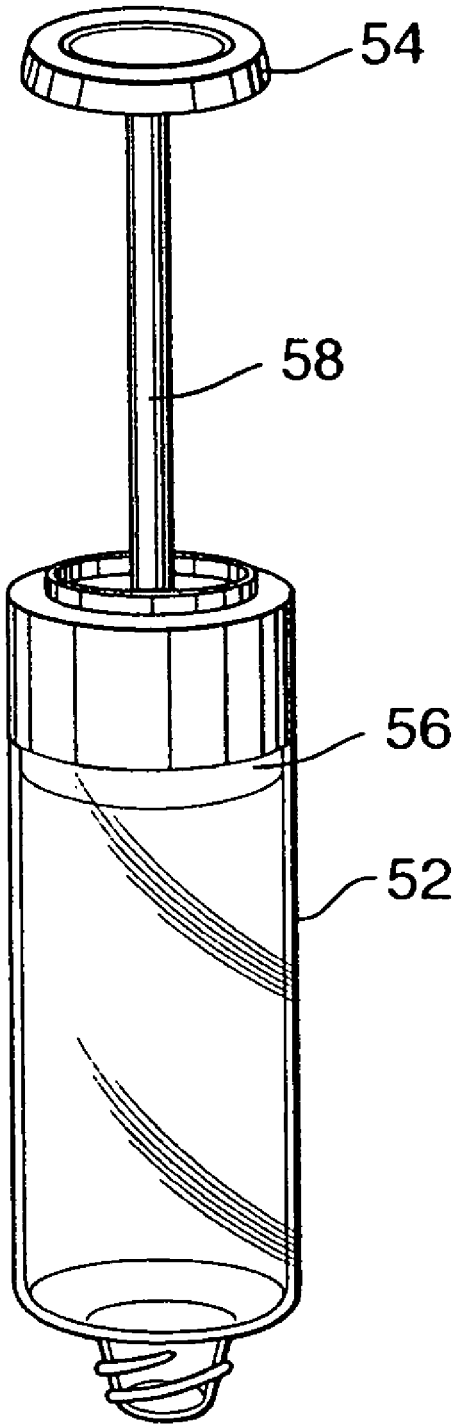
FIG. 5 is a side view of an accessory for use with the apparatus of FIGS. 1 to 4.

An accessory of the device is shown in FIG. 5. Moreover, rather than a rotating plate being provided, a pair of rods may rotate around the edge of the stuffing drum 14 by a pair of connectors that are attached to the handle 22. At the opposite side of the stuffing drum from the handle 22 or at any other convenient location may be a battery housing, which contains circuitry and a small power source. Wires may travel through the connectors 46 to the rods 44, where lighting elements, such as LEDs may be located, to provide a pleasing visual effect. Furthermore, a sound chip may be provided to produce musical or other sounds.

As shown in FIG. 5, the stuffing drum may be provided with a cylindrical canister 52 that is provided with a piston 56 that can be moved by a user by means of a rod 58 that has a handle 54 on it. The canister 52 mounts directly on the top of the drum, to the opening thereof.

The canister 52 is mounted directly above and in communication with the drum, and can be filled with a preferably pre-measured quantity of stuffing by withdrawing the piston up through the canister until it is free of the canister, and then adding the stuffing to the canister. The piston is then mounted on the drum, for instance by screw threads, and actuated by grasping the handle and pushing it in a downward direction. This forces the stuffing from the canister into the drum. As necessary, the plunger is pushed downwardly to force more stuffing from the canister into the drum, and from there, into the auger housing.

It will be understood, moreover, that within the overall inventive concept of the present invention are the stuffing machine of the present invention, the combination of the stuffing machine and plush skins, and kits including a machine according to the present invention, stuffing, and one or more skins.

While there have shown and described and pointed out fundamental novel features of the invention as applied to a preferred embodiment thereof, it will be understood that various omissions and substitutions and changes in the form and details of the method steps described, the devices illustrated, and the operation thereof, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus for inserting stuffing into an outer fabric casing, comprising:

a) a hollow outer casing, including:

a. a stuffing drum with a first end, a second end, and an opening for receiving the stuffing, and b. an auger housing located below and communicating with the stuffing drum, said auger housing including a stuffing exit;

b) at least one rotating member for rotating about a horizontal axis within the stuffing drum, the member being rotated by rotating means connected to the exterior of the first end of the stuffing drum;

c) a rotating auger within the auger housing; and d) drive means for rotating said auger upon rotation of said rotating means.

2. The apparatus as claimed in claim 1, wherein the rotating member is a flat plate with a diameter less than the interior of the stuffing drum.

3. The apparatus as claimed in claim 2, wherein the hollow outer casing includes transparent portions to allow the interior of the casing to be visible as the apparatus is used.

4. The apparatus as claimed in claim 2, including a battery housing.

5. The apparatus as claimed in claim 1, wherein the rotating member includes:

a) a connector positioned at the first end of the interior of the stuffing drum attached to a rotating member gear, the connector having a length slightly less than the interior diameter of the drum; and b) a pair of rods attached to each end of the connector, each rod having a length slightly less than the length of the stuffing drum.

6. The apparatus as claimed in claim 5, wherein the drive means includes gears operably connecting said rotating member gear and said auger.

7. The apparatus as claimed in claim 5, wherein the hollow outer casing includes transparent portions to allow the interior of the casing to be visible as the apparatus is used.

8. The apparatus as claimed in claim 5, including a battery housing.

9. The apparatus as claimed in claim 1, wherein the opening at the top of the stuffing drum may be covered by a screw top.

10. The apparatus as claimed in claim 1, wherein the drive means is a ratchet gear system, thereby only allowing for turning of the rotating means in one direction.

11. The apparatus as claimed in claim 1, wherein the hollow outer casing includes transparent portions to allow the interior of the casing to be visible as the apparatus is used.

12. The apparatus as claimed in claim 1, including a battery housing.

13. The apparatus as claimed in claim 12, wherein the rotating member further includes lighting elements connected by wires to the battery housing.

14. The apparatus as claimed in claim 1, wherein the rotating means includes a handle to be rotated manually.

15. The apparatus as claimed in claim 1, wherein the rotating means includes a motor.

16. The apparatus as claimed in claim 1, wherein the stuffing exit includes a tapered nozzle.

17. A kit for making a stuffed toy at home, comprising:

a) an outer fabric casing including closure means;

b) stuffing to fit within the outer fabric casing;

c) an apparatus for inserting the stuffing into the outer fabric casing, as claimed in claim 1.

* * * * *